US007100951B2

(12) United States Patent
Jien

(10) Patent No.: US 7,100,951 B2
(45) Date of Patent: Sep. 5, 2006

(54) WATER GATE LOCKER

(75) Inventor: Lee-Wen Jien, Kaohsiung (TW)

(73) Assignee: Tyrone Marine Hardware Co., Ltd., Kaohsiung (TW)

( * ) Notice: Subject to any disclaimer, the term of this patent is extended or adjusted under 35 U.S.C. 154(b) by 155 days.

(21) Appl. No.: 10/920,300

(22) Filed: Aug. 18, 2004

(65) Prior Publication Data

US 2006/0038414 A1 Feb. 23, 2006

(51) Int. Cl.
*E05C 3/12* (2006.01)
*E05C 3/14* (2006.01)

(52) U.S. Cl. ..... 292/207; 292/240; 292/241; 292/257; 292/336.3; 292/DIG. 37

(58) Field of Classification Search ..... 292/207, 292/240–242, 57, 63, 65, DIG. 29, 30, 45, 292/69, 37, 202–204, 140, 145, 165, 182, 292/336.3, 1, 257; 405/87, 106; 70/207, 70/218, 220, 145, 211, DIG. 67, 31, 20, 24, 70/23

See application file for complete search history.

(56) References Cited

U.S. PATENT DOCUMENTS 2,310,348 A * 2/1943 Blears ..... 292/202
2,648,967 A * 8/1953 Holmsten ..... 70/89
4,155,579 A * 5/1979 Sanok, Jr. ..... 292/336.3
5,634,357 A * 6/1997 Nutter et al. ..... 70/210

* cited by examiner

*Primary Examiner*—Brian E. Glessner
*Assistant Examiner*—K. Gluchowski
(74) *Attorney, Agent, or Firm*—Troxell Law Office, PLLC

(57) ABSTRACT

A water gate locker comprises a locker body, a bracket, a fastener-seat, a press-bolt, a position-ring, a nut. A position-slice is extended from one side of the locker body and a turning-axle is extended downward from the bottom of the locker body, and a thread is provided at the front end of the turning-axle, and a hole, with the upper portion larger than the lower, is provided on the locker body, and is penetrated through by a press-bolt, a screw-hole is provided at each side of the bracket, and a protrudent-cylinder is protruded upward from the middle of bracket, and an axle-hole is penetrated through the protrudent-cylinder, and two fastener-portions are penetrated beside the axle-hole, and a runner in an arc form with smaller diameter is penetrated between the two fastener-portions, a screw-hole is provided at each side of the fastener-seat, and a position-plate is extended upward from a side of the fastener-seat, and a position-runner is provided on a suitable portion of the position-plate, the turning-axle of the locker body is fitted in the axle-hole of the protrudent-cylinder of the bracket, and the locker body is integrated with the bracket via a nut, and the bottom end of the press-bolt is protruded from the runner of the protrudent-cylinder, and then a position-ring is combined with the bottom end of the press-bolt. Accordingly, the water gate locker according to the present invention is formed.

4 Claims, 6 Drawing Sheets

WATER GATE LOCKER

BACKGROUND OF THE INVENTION

1. Field of the Invention

The present invention relates to a water gate locker, particularly to a water gate locker, in which a positioning device is installed in the locker body, which facilitates achieving the position of the water gate by using said positioning device.

2. Description of the Prior Art

FIG. 1 shows the structural schematic diagram of a conventional water gate locker, which mainly comprises a locker 11, a position-seat 12, and a fastener-seat 13, wherein the locker 11 has an extended position-slice 111 at one side thereof, combined with a position-seat 12, and connected with the position-seat 12 each other by using a position-bolt 112; a position-runner 131 is provided on the fastener-seat 13; when the user want to close the water gate, the user only needs to turn the locker 11 90° to allow the position-slice 111 of the locker 11 to be locked in the position-runner 131 on the fastener-seat 13, and thus achieving the positioning of the water gate. Although this mechanism can maintain the water gate in desired position, the user may dash against the locker 11 during marching or performing anything else, which may cause the position-slice 111 of the locker 11 to be separated from the position-runner 131 of the fastener-seat 13, and thus the object of using the locker 11 to position the water gate cannot be achieved.

Thus it can be seen, the above-mentioned conventional water gate locker still has drawbacks, not designed well actually, and need improved urgently.

In view of disadvantages derived from the above-mentioned conventional water gate locker, the present inventor had devoted to improve and innovate, and, after studying intensively for years, developed successfully a water gate locker according to the invention.

SUMMARY OF THE INVENTION

These features and advantages of the present invention will be fully understood and appreciated from the following detailed description of the accompanying Drawings.

The object of the present invention is to provide a water gate locker, in which the position-ring combined at the lower end of the press-bolt is used to unlock/lock the fastener-portion of the bracket, that can achieve the effect of which allows the locker body to be positioned easily and come off unlikely.

The another object of the present invention is to provide a water gate locker having many advantages, such as a simple structure, easy manufacture, etc,.

The water gate locker capable of achieving the above-mentioned objects comprises a locker body, a bracket, a fastener-seat, a press-bolt, a position-ring, a nut, wherein a position-slice is extended from one side of the locker body and a turning-axle is extended downward from the bottom of the locker body, and a thread is provided at the front end of the turning-axle, and a hole, with the upper portion larger than the lower, is provided on the locker body, and is penetrated through by a press-bolt, a screw-hole is provided at each side of the bracket, and a protrudent-cylinder is protruded upward from the middle of bracket, the inside of the protrudent-cylinder 22 is hollow, and an axle-hole is penetrated through the protrudent-cylinder, and two fastener-portions are penetrated beside the axle-hole, and a runner in an arc form with smaller diameter is penetrated between the two fastener-portions, the press-bolt is a bolt with the upper portion larger than the lower and a column is protruded from the lower end of the press-bolt; the position-ring in which a hole, having the same size with the column at the lower end of the press-bolt, is provided at the middle of the position-ring; the fastener-seat in which a screw-hole is provided at each side of the fastener-seat and a position-plate is extended upward from a side of the fastener-seat and a position-runner is provided on a suitable portion of the position-plate; the spacer in which an axle-hole is provided at the middle of the spacer and a hole at the side of the spacer; a hole is provided at the middle of the spacer-ring; the seal-plate is a circular plate.

First, the turning-axle of the locker body is fitted in the axle-hole of the bracket, and then the turning-axle of the locker body with a spacer is penetrated in the axle-hole of the protrudent-cylinder of the bracket. After the turning-axle is inserted into the axle-hole of the protrudent-cylinder, a spacer-ring is fitted in the turning-axle and fixed by using a nut to be screwed on the thread at the front end of the turning-axle, thus the bracket and the locker body can be united firmly, and then a spring is placed in the hole of the locker body and the press-bolt is inserted into the spring, at this time, the column at the lower end of the press-bolt will be inserted into the hole of the spacer, and then the fastener-portion of the bracket is inserted into the protrudent-cylinder, and then a position-ring is combined with the column at the lower end of the press-bolt, thus the press-bolt cannot depart from the hole of the locker body, and finally, a seal-plate is provided to combine with the protrudent-cylinder of the bracket. Thus, after the all above-mentioned components are assembled, the water gate locker of the present invention is formed.

DETAILED DESCRIPTION OF THE PREFERRED EMBODIMENT

Figure 1:
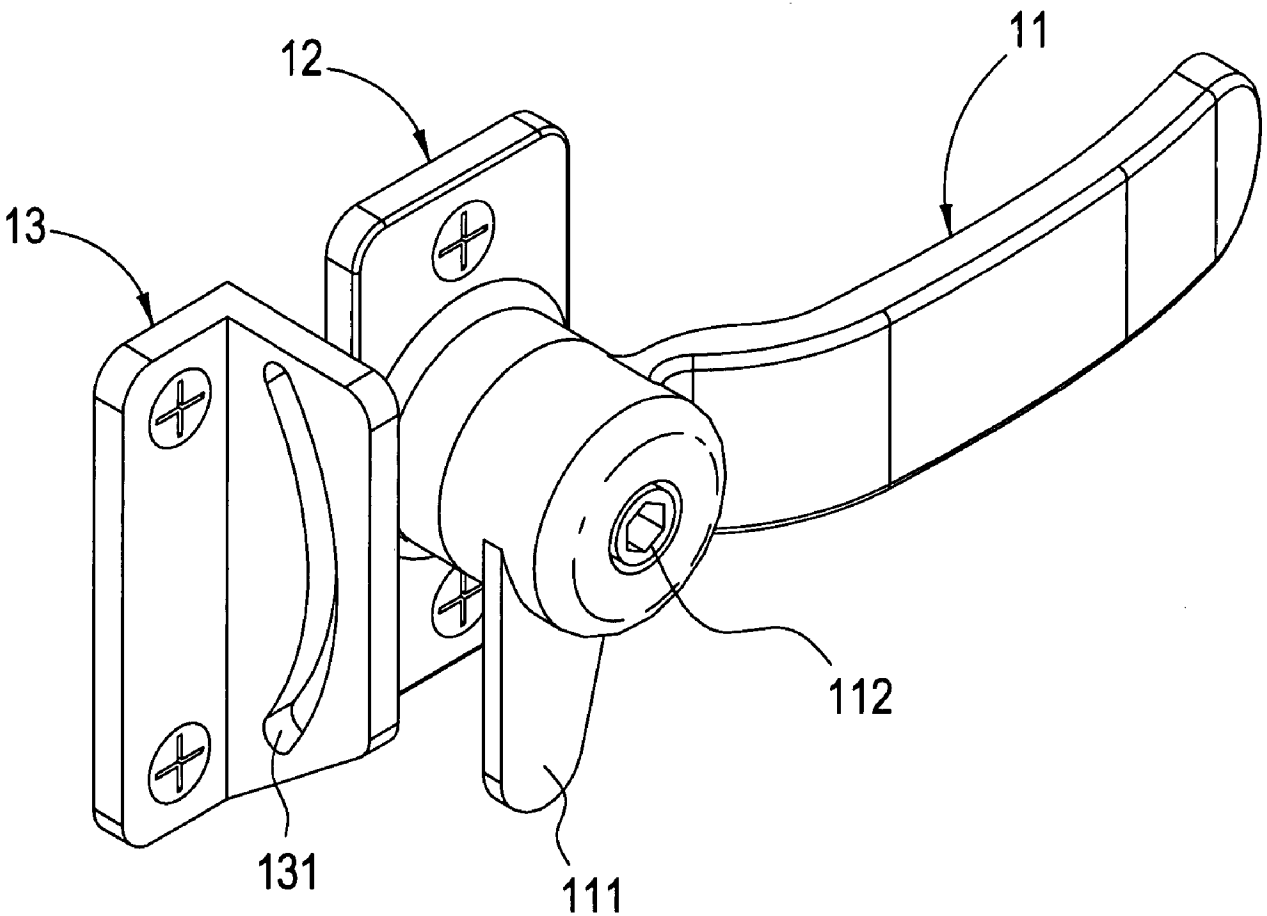
PRIOR ART FIG. 1
FIG. 1 shows the structural schematic diagram of a conventional water gate locker.
Figure 2:
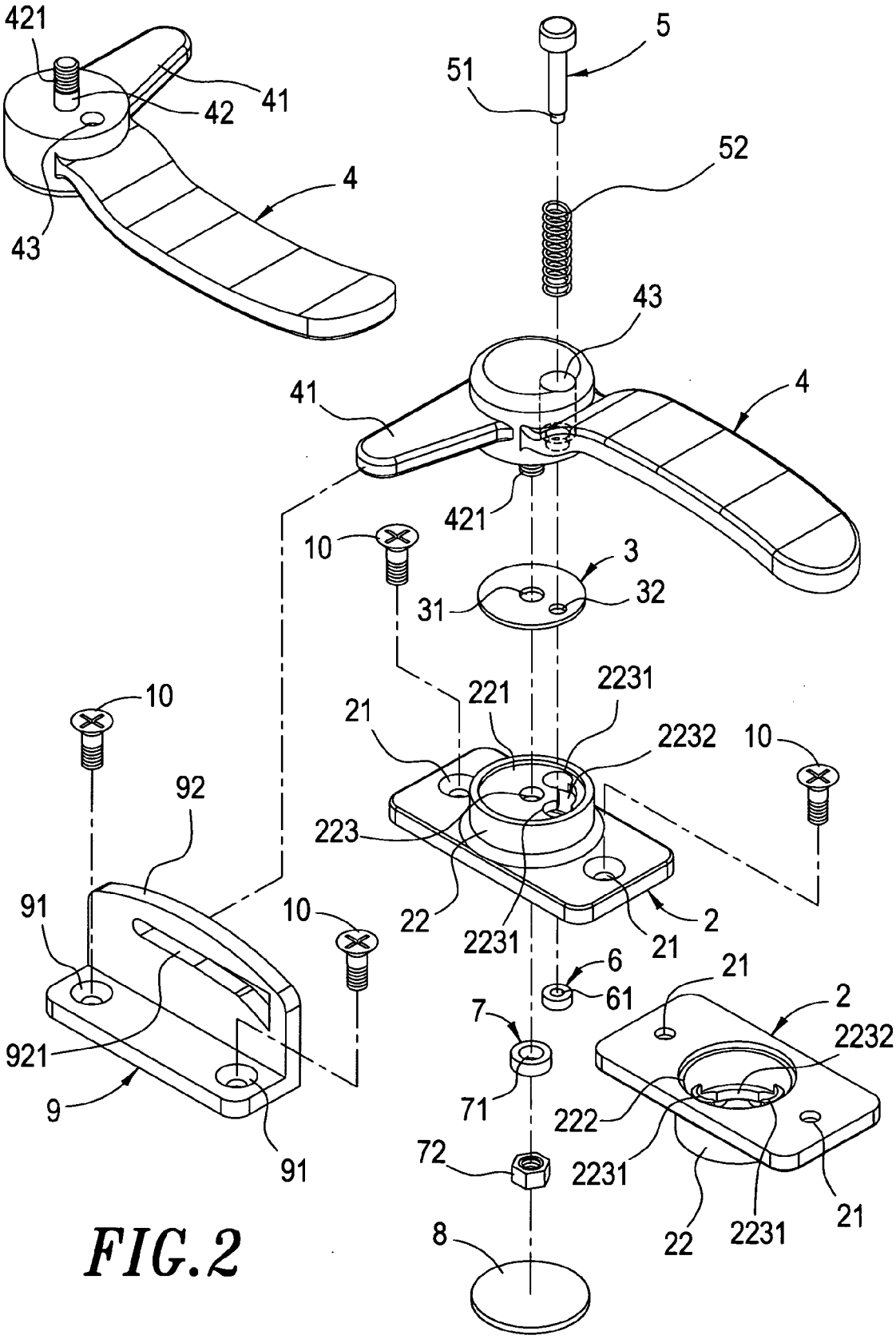
FIG. 2 shows the stereo decomposition view of the water gate locker according to the present invention.
Figure 3:
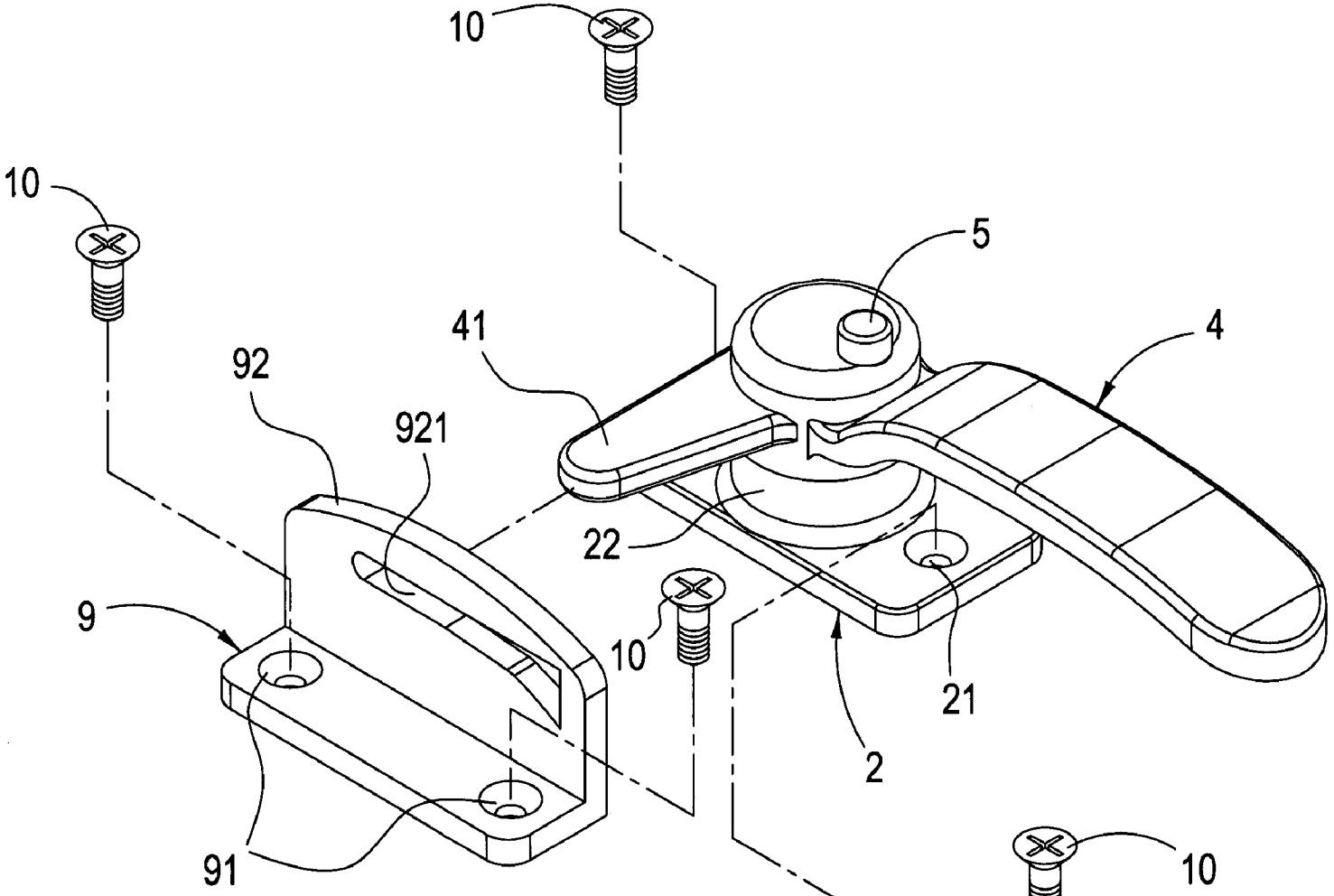
FIG. 3 shows the view of the partial combination of the water gate locker according to the present invention.

As shown in FIGS. 2 and 3, a water gate locker according to the present invention mainly comprising:

a bracket 2, in which a screw-hole 21 is provided at each side of the bracket 2, and a protrudent-cylinder 22 is protruded upward from the middle of bracket 2, and the inside of the protrudent-cylinder 22 is hollow, and a pit-portion 221 is concaved on the upper side of the protrudent-cylinder 22, a fillister 222 is concaved on the lower side of the protrudent-cylinder 22, and an axle-hole 223 is penetrated in the middle of the protrudent-cylinder 22, and two fastener-portions 2231 are penetrated at suitable locations beside the axle-hole 223, and a runner 2232 in an arc form with smaller diameter is penetrated between the two fastener-portions 2231 so that the two fastener-portions 2231 and the runner 2232 are channelized; thus the screw-holes 21 can be used to position the bracket with screws 10;

a spacer 3, in which an axle-hole 31 is provided at the middle of the spacer 3 and a hole 32 at the side of the spacer 3, being arranged on the pit-portion 221 of the protrudent-cylinder 22 of the bracket 2; the spacer 3 being a plastic material, which can more facilitate the rotation of the locker body 4;

a locker body 4, in which a position-slice 41 is extended from one side of the locker body 4 and a turning-axle 42 is extended downward from the bottom of the locker body 4, and a thread 421 is provided at the front end of the turning-axle 42, and a hole 43, with the upper portion larger than the lower, is provided at a suitable position of the locker body 4; the turning-axle 42 of the locker body 4 is fitted in the axle-hole 223 of the bracket 2 such that the hole 43 of the locker body 4 corresponds to the fastener-portion 2231 of the bracket 2;

a press-bolt 5, with the upper portion larger than the lower, in which a column 51 is protruded downward from the lower end of the press-bolt 5, and a spring 52 is provided to encircle the lower portion of the press-bolt 5; the press-bolt 5 along with the spring 51 being fitted in the hole 43 of the locker body 4 and the column 52 at the lower end of the press-bolt 5 protruding from the hole 43;

a position-ring 6, in which a hole 61, having the same size with the column 51 at the lower end of the press-bolt 5, is provided at the middle of the position-ring 6; the position-ring 6 being integrated with the column 51 of the press-bolt 5;

a spacer-ring 7, in which a hole 71 is provided at the middle of the spacer-ring 7; the spacer-ring 7 is fitted in the turning-axle 42 protruded from the protrudent-cylinder 22 of the bracket 2 and fixed by using a nut 72 to be screwed on the thread 421 at the front end of the turning-axle 42, thus the bracket 2 and the locker body 4 can be united firmly;

a seal-plate 8, which is a circular plate, provided to combine with the protrudent-cylinder 22 of the bracket 2 as fitted into the fillister 222, and thus the lower side of the protrudent-cylinder 22 of the bracket 2 can be sealed;

a fastener-seat 9, in which a screw-hole 91 is provided at each side of the fastener-seat 9, and a position-plate 92 is extended upward from a side of the fastener-seat 9, and a position-runner 921 is provided on a suitable portion of the position-plate 92; the screw-hole 91 can position the bracket 2 by using a screw 10.

Figure 4B:
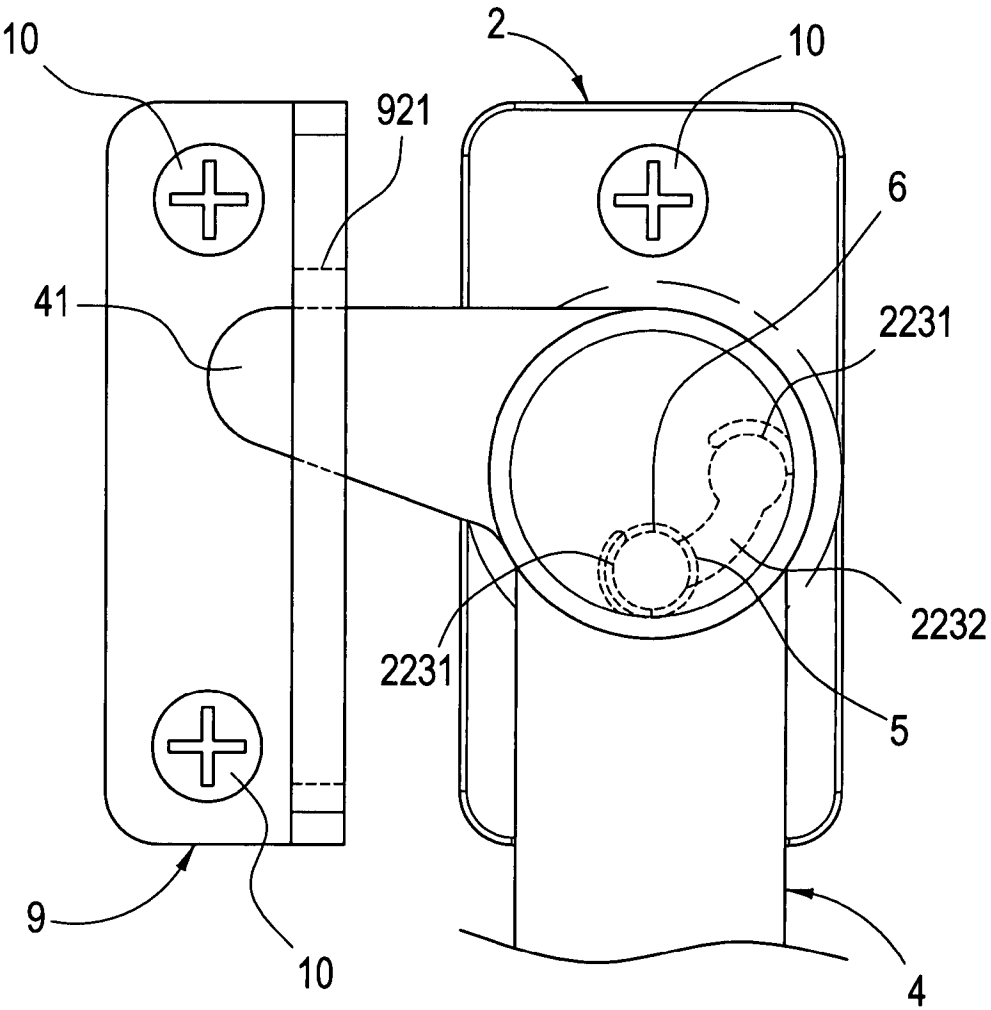
FIG. 4A–4D show the sectional schematic diagram of the operation of the water gate locker according to the present invention.
Figure 4A:
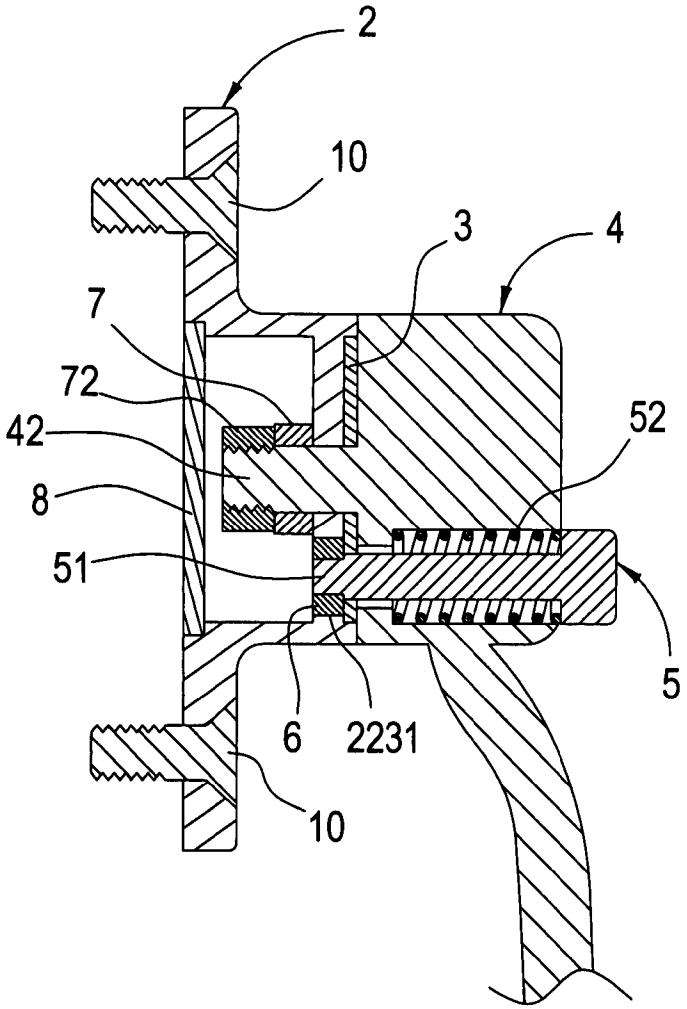
Figure 4D:
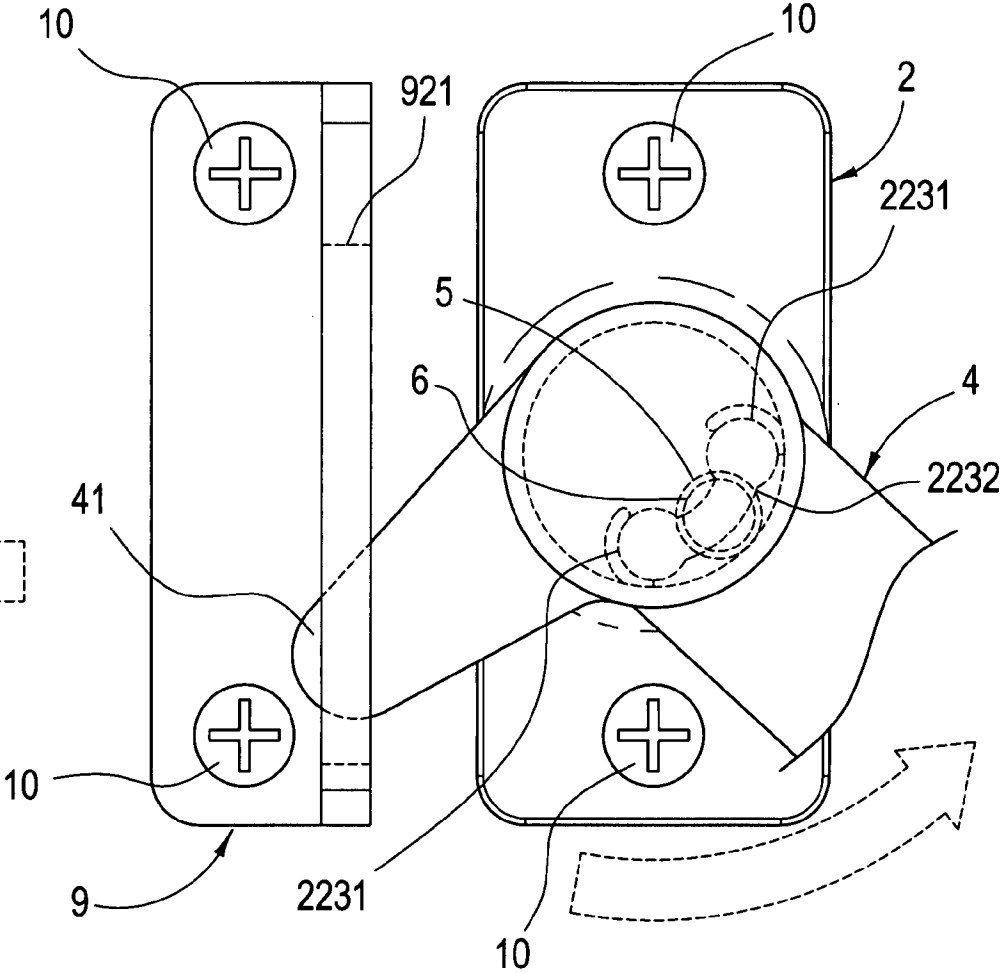
Figure 4C:
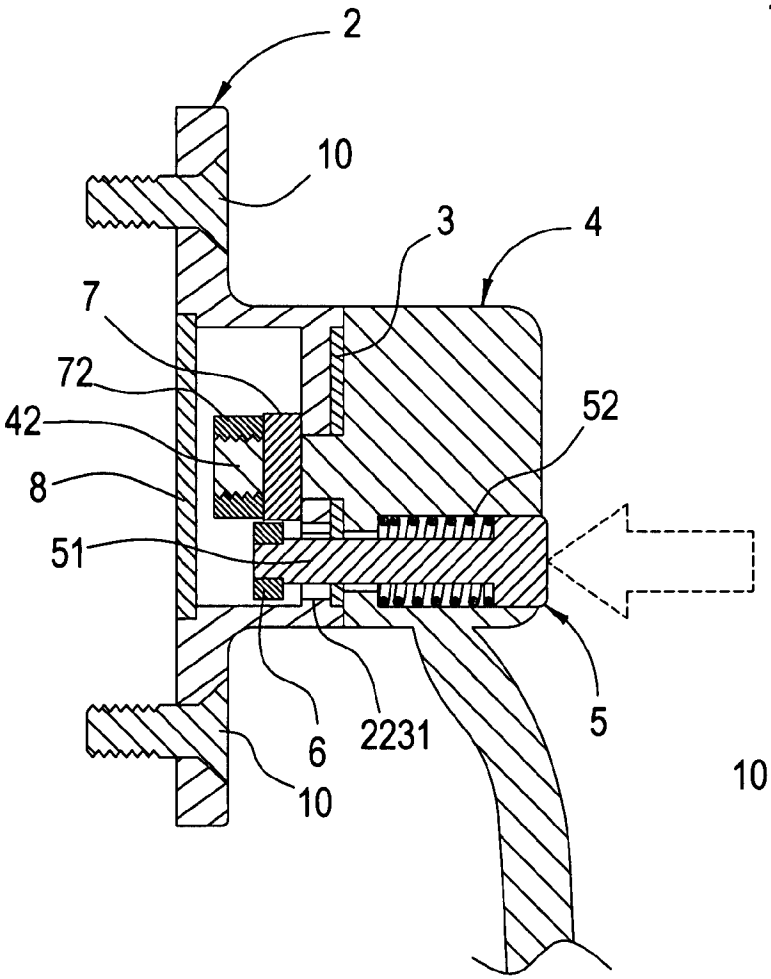
Figure 5A:
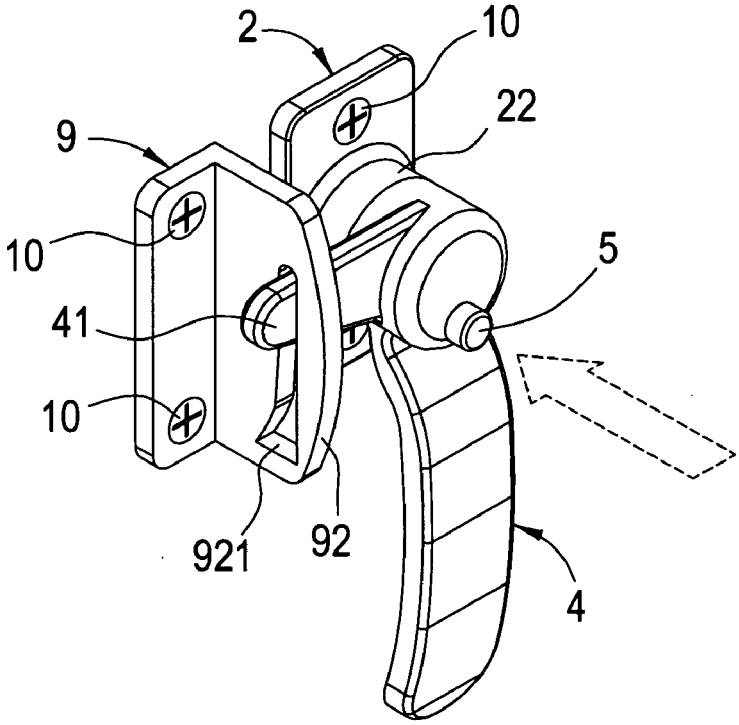
FIGS. 5A and 5B show the implementation schematic diagram of the water gate locker according to the present invention.
Figure 5B:
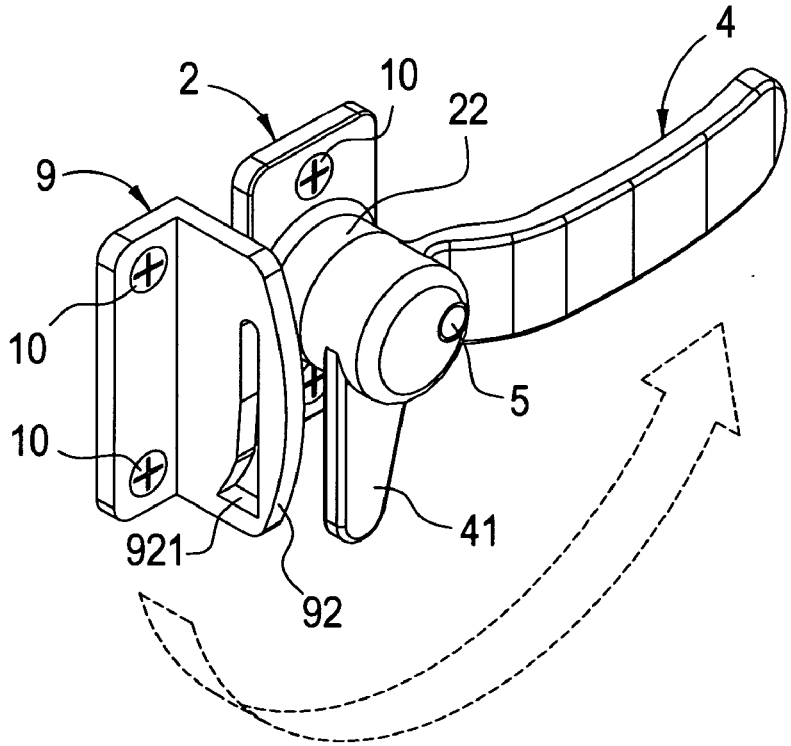

FIGS. 4A, B, C, and D are the sectional schematic diagram of the operation, and FIGS. 5A and 5B the implementation schematic diagram, of the water gate locker according to the present invention. When the locker body 4 is positioned, the position-ring 6 combined at the lower end of the press-bolt 5 will be stuck in the fastener-portion 2231 of the protrudent-cylinder 22, as shown in FIGS. 4A and 4B; if the user wants to turn the locker body 4, presses down the press-bolt 5 firstly, causing the position-ring 6 at the lower end of the press-bolt 5 to depart from the fastener-portion 2231 of the protrudent-cylinder 42, as shown in FIGS. 4C and 4D, and then turns the locker body 4, causing the position-slice 41 of the locker body 4 to depart from the position-runner 921 of the fastener-seat 9, when the locker body 4 being turned 90°, the position-ring 6 will be rolled to another fastener-portion 2231, since the press-bolt 5 is affected by the restoring force of the spring 52 when reaching said another fastener-portion 2231, the position-ring 6 of the press-bolt 5 again being stuck in the fastener-portion 2231, at this time, the water gate can be opened; according to the above-mentioned manner, the present invention not only can obtain the effect of positioning the locker body 4 easily, also can avoid the user from dashing against the locker body 4 unintentionally, which may cause the position-slice 41 of the locker body 4 to depart from the position-runner 921 of the fastener-seat 9, made the effect of positioning the locker body unachievable.

As compared with other conventional techniques, the water gate locker according to the present invention has following advantages:

1. The present invention provides a water gate locker, in which the position-ring combined at the lower end of the press-bolt is used to unlock/lock the fastener-portion of the bracket, that can achieve the effect of which allows the locker body to be positioned easily and come off unlikely.

2. The present invention provides a water gate locker, having a simple structure and being manufactured easily, that can achieve the effect of which allows the locker body to be positioned easily and come off unlikely.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A water gate locker, comprising:

a bracket, in which a screw-hole is provided at each side of the bracket, and a protrudent-cylinder is protruded upward from the middle of bracket, and the inside of the protrudent-cylinder is hollow, and a pit-portion is concaved on the upper side of the protrudent-cylinder, a fillister is concaved on the lower side of the protrudent-cylinder, and an axle-hole is penetrated in the middle of the protrudent-cylinder, and two fastener-portions are penetrated at suitable locations beside the axle-hole, and a runner in an arc form with smaller diameter is penetrated between the two fastener-portions so that the two fastener-portions and the runner are channelized;

a spacer, in which an axle-hole is provided at the middle of the spacer and a hole at the side of the spacer, being arranged on the pit-portion of the protrudent-cylinder of the bracket;

a locker body, in which a position-slice is extended from one side of the locker body and a turning-axle is extended downward from the bottom of the locker body, and a thread is provided at the front end of the turning-axle, and a hole, with the upper portion larger than the lower, is provided at a suitable position of the locker body; the turning-axle of the locker body is fitted in the axle-hole of the bracket such that the hole of the locker body corresponds to the fastener-portion of the bracket;

a press-bolt, with the upper portion larger than the lower, in which a spring being provided to encircle the lower portion of the press-bolt, and a column is protruded downward from the lower end of the press-bolt; the press-bolt along with the spring being fitted in the hole of the locker body and the column at the lower end of the press-bolt protruding from the hole;

a position-ring, in which a hole is provided; the position-ring being integrated with the column of the press-bolt;

a spacer-ring, in which a hole is provided; the spacer-ring being fitted in the turning-axle protruded from the protrudent-cylinder of the bracket and fixed by using a nut to be screwed on the thread at the front end of the turning-axle;

a seal-plate, which is a circular plate, provided to combine with the protrudent-cylinder of the bracket as fitted into the fillister;

a fastener-seat, in which at least one screw-hole is provided on the fastener-seat, and a position-plate is extended upward from a side of the fastener-seat, and a position-runner is provided on a suitable portion of the position-plate, which can be formed according to the above-mentioned construction of components.

2. The water gate locker of claim 1, wherein the screw-hole of the bracket can use a screw to position the bracket.

3. The water gate locker of claim 1, wherein the screw-hole of the fastener-seat can use a screw to position the fastener-seat.

4. The water gate locker of claim 1, wherein the position-slice of the locker body will be stuck in the position-runner of the fastener-seat after the position-slice of the locker body being turned.

* * * * *